United States Patent [19]

Ferns

[11] Patent Number: 4,909,660

[45] Date of Patent: Mar. 20, 1990

[54] GRATING WITH A LOCKING MECHANISM

[75] Inventor: Derek Ferns, Gwent, Great Britain

[73] Assignee: Von Roll, AG., Gerlafingen, Switzerland

[21] Appl. No.: 149,752

[22] Filed: Jan. 29, 1988

[30] Foreign Application Priority Data

Feb. 2, 1987 [GB] United Kingdom ..... 8702221
Feb. 5, 1987 [GB] United Kingdom ..... 8702585

[51] Int. Cl.[4] ..... E01C 11/22

[52] U.S. Cl. ..... 404/2; 52/507; 52/664; 404/4

[58] Field of Search ..... 404/2–5, 404/25, 26; 52/19, 20, 507, 664; 210/164; 49/465; 220/307

[56] References Cited

U.S. PATENT DOCUMENTS

Re. 26,366 4/1968 Flegel ..... 404/25 X
3,881,832 5/1975 Ferns ..... 404/4
4,126,404 11/1978 Ferns ..... 404/4
4,504,009 3/1985 Bolk et al. ..... 220/307 X
4,661,245 4/1987 Rutherford et al. ..... 52/507 X
4,761,319 8/1988 Kraus et al. ..... 49/465

FOREIGN PATENT DOCUMENTS 2119836 11/1983 United Kingdom ..... 210/164

*Primary Examiner*—Jerome W. Massie, IV
*Assistant Examiner*—Matthew Smith
*Attorney, Agent, or Firm*—Helfgott & Karas

[57] ABSTRACT

A cover assembly for an opening comprises a frame and a covering. At least one elastically deformable, rod-like closing member is provided on the covering. The closing member forms one part of a locking device, the other part of which is a retaining member which includes a groove provided in the frame, in which can engage a closing finger located on the closing member accompanied by the elastic deformation of the closing member. Thus, in a simple manner, the covering is positively secured in the frame.

3 Claims, 5 Drawing Sheets

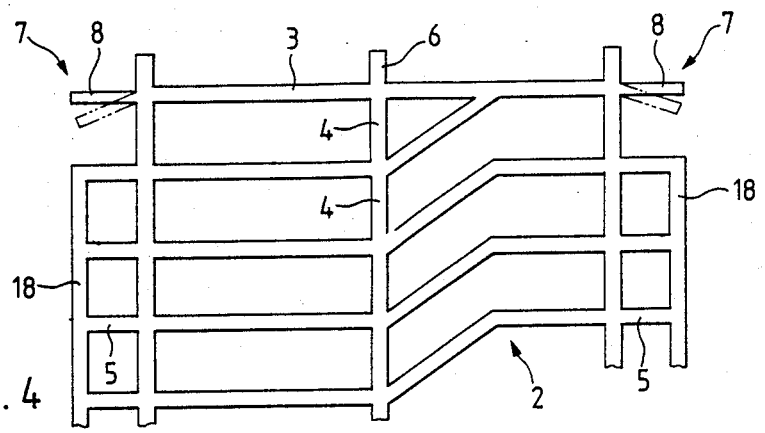
FIG. 4
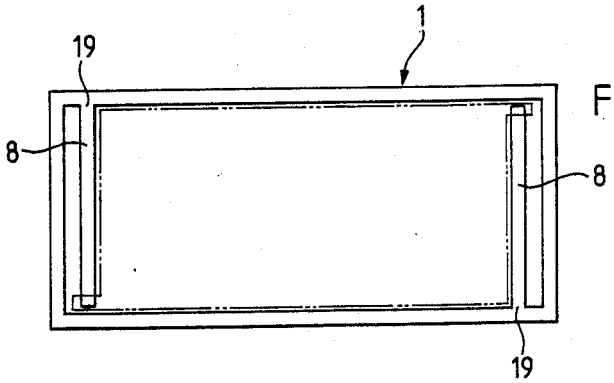
FIG. 5
FIG. 8
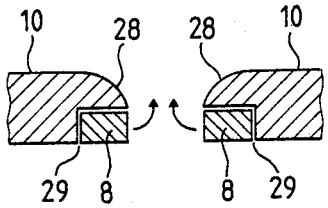
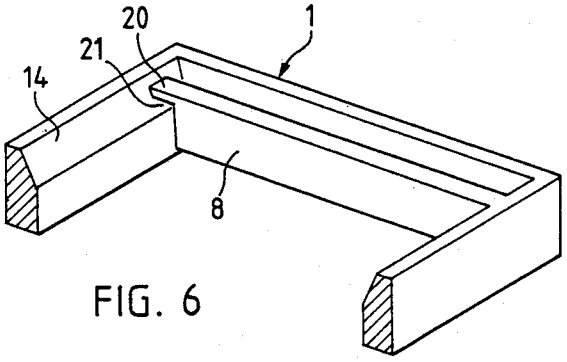
FIG. 6
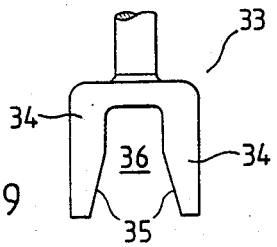
FIG. 9

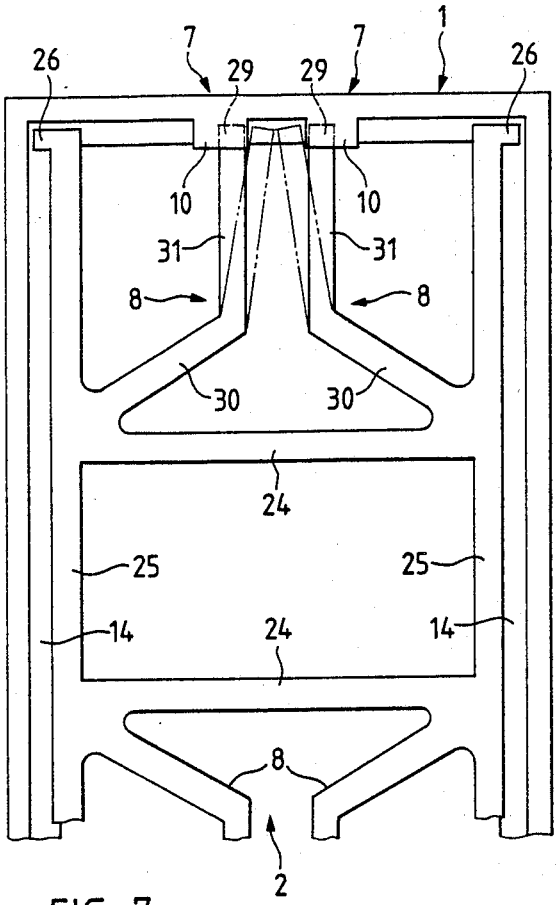
FIG. 7
FIG. 11
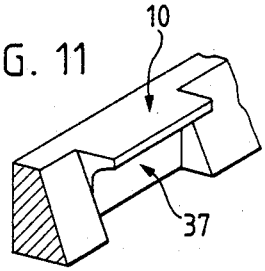
FIG. 12
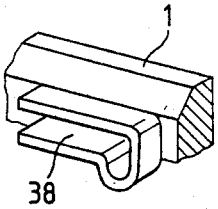
FIG. 13
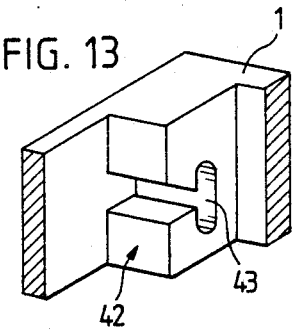
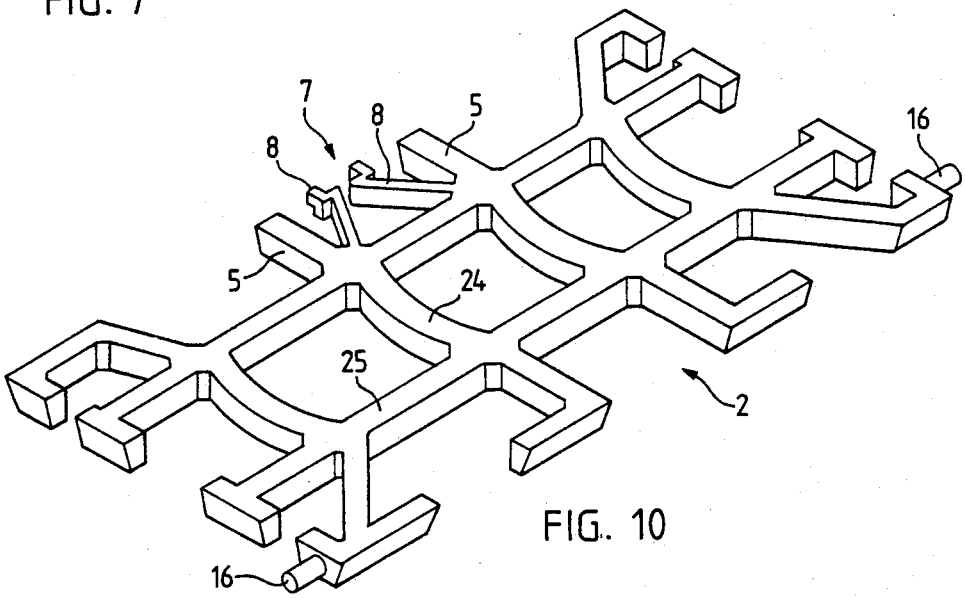
FIG. 10

GRATING WITH A LOCKING MECHANISM

The invention relates to a means for securing a covering comprising a frame and a cover or grating closing an opening, the cover or grating being secured by a locking device against undesired displacement or removal thereof.

The invention relates to the field of road equipment, in which coverings are used for openings, e.g. of shafts, sewers and water drains, whereby the opening is covered by the cover or grating, but the latter can be removed for specific purposes, e.g. inspections. Such coverings are used in courtyards, lobbies, floors of buildings, etc., as well as on roads.

Numerous different constructions of such coverings are known. They essentially comprise a frame and a cover or grating, the upper edge of the frame and the cover generally being aligned with the ground surface. The cover or grating of such a covering must be able to withstand all the stresses and loads which occur, without any displacement or being removable from the frame.

A lightweight construction is increasingly being used for such covers or gratings to reduce the weight. Materials are also used which have a higher strength, such as e.g. cast iron with nodular graphite. In such a known covering according to British patent No. 1 539 677 use is made of a grating comprising a plurality of juxtaposed, spaced bars, which are connected at opposite ends to the adjacent bar in each case. As a result of the winding connection of the bars, the grating is overall an elastic element, which can be compressed and can in this way be inserted in the frame, where it can be engaged in the case of expansion in the latter. However, it is disadvantage of this construction that, due to the relatively high elasticity of the cover, the latter can become elastically deformed when vehicles travel over it, so that it can jump out of the frame.

The problem of the present invention is to so construct a means of the aforementioned type that even when the cover or grating is made from a high strength material, it is not possible to remove it from the frame.

According to the invention this problem is solved in that either on the substantially dimensionally stable frame, or on the substantially dimensionally stable cover or grating is provided at least one elastically deformable, rod-like closing member, which is constructed as part of the locking device, whilst the other part of the locking device is a retaining member, which is located in the cover or grating or in the frame and in which the closing member can engage, whilst utilizing its elastic deformability.

Figure 1:
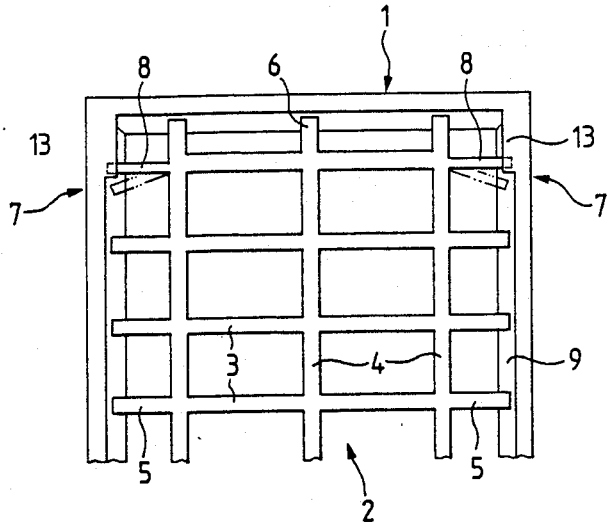

The invention is described in greater detail hereinafter relative to non-limitative embodiments and the attached drawings, wherein show:

FIG. 1 A diagrammatically represented plan view of a grating placed in a frame with a locking device.

Figure 2:
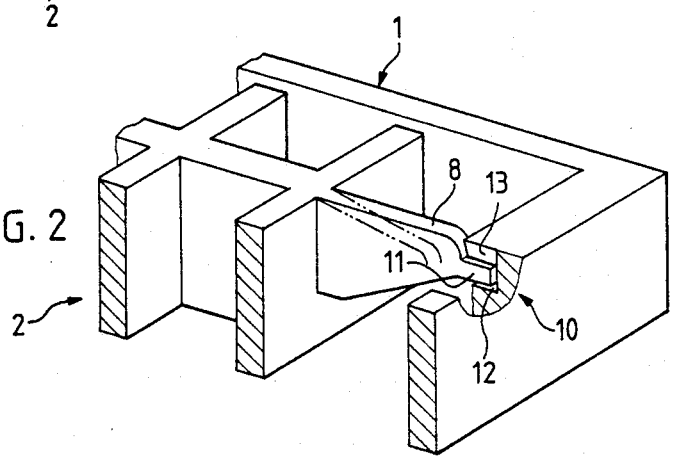

FIG. 2 A partial view of the grating and the frame according to FIG. 1 in a larger scale, three-dimensional representation.

Figure 3:
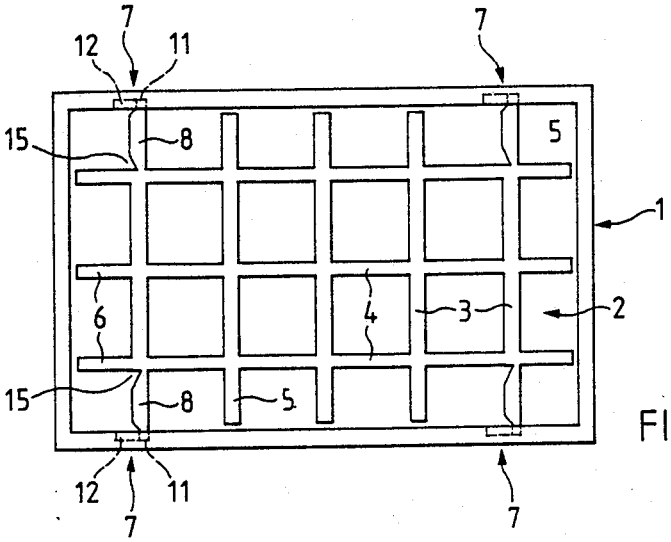

FIG. 3 A diagrammatically represented plan view of a further grating inserted in a frame with a locking device.

FIG. 4 A diagrammatically represented plan view of a grating for a covering.

FIG. 5 A diagrammatically represented plan view of a frame for a cover or grating.

FIG. 6 A partial view of the frame according to FIG. 5 in a larger scale, three-dimensional representation.

FIG. 7 A diagrammatically represented plan view of a grating inserted in a frame with a locking device.

FIG. 8 A detail of the locking device of FIG. 7.

FIG. 9 A view of an actuating fork for the locking device according to FIG. 7.

FIG. 10 A diagrammatically represented view of a grating with a locking device similar to that of FIG. 7 in a three-dimensional representation.

FIG. 11 A diagrammatically represented view of a retaining member for a locking device according to FIG. 10 in three-dimensional form.

Figure 14:
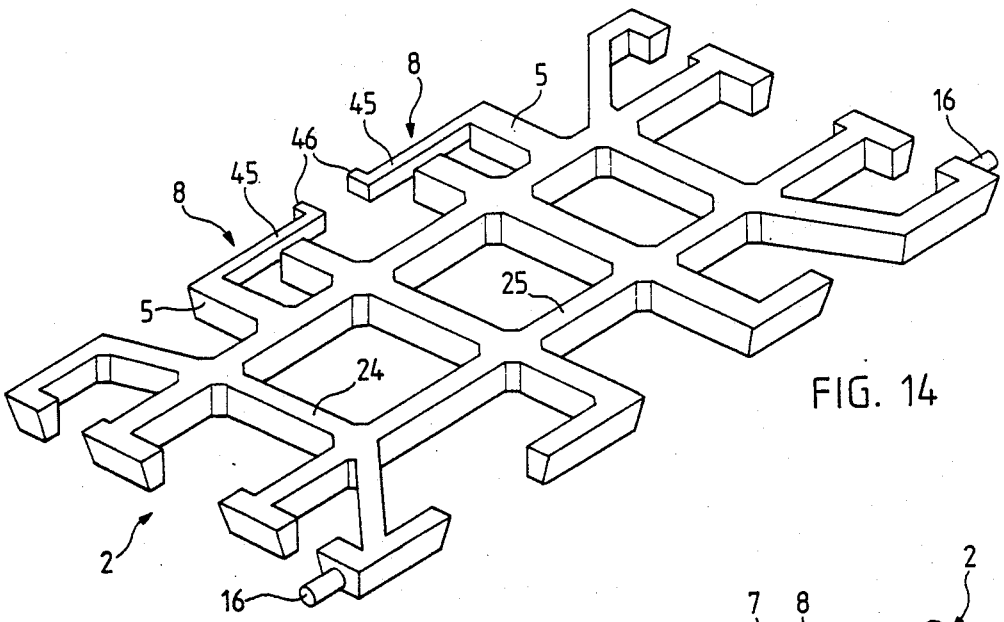

FIG. 12 A diagrammatically represented view of a mounting support for a grating according to FIGS. 10 or 14.

FIG. 13 A diagrammatically represented view of a further grating mounting support provided in the frame in accordance with FIGS. 10 or 14.

FIG. 14 A diagrammatically represented view of a grating with a further locking device in a three-dimensional representation.

Figure 15:
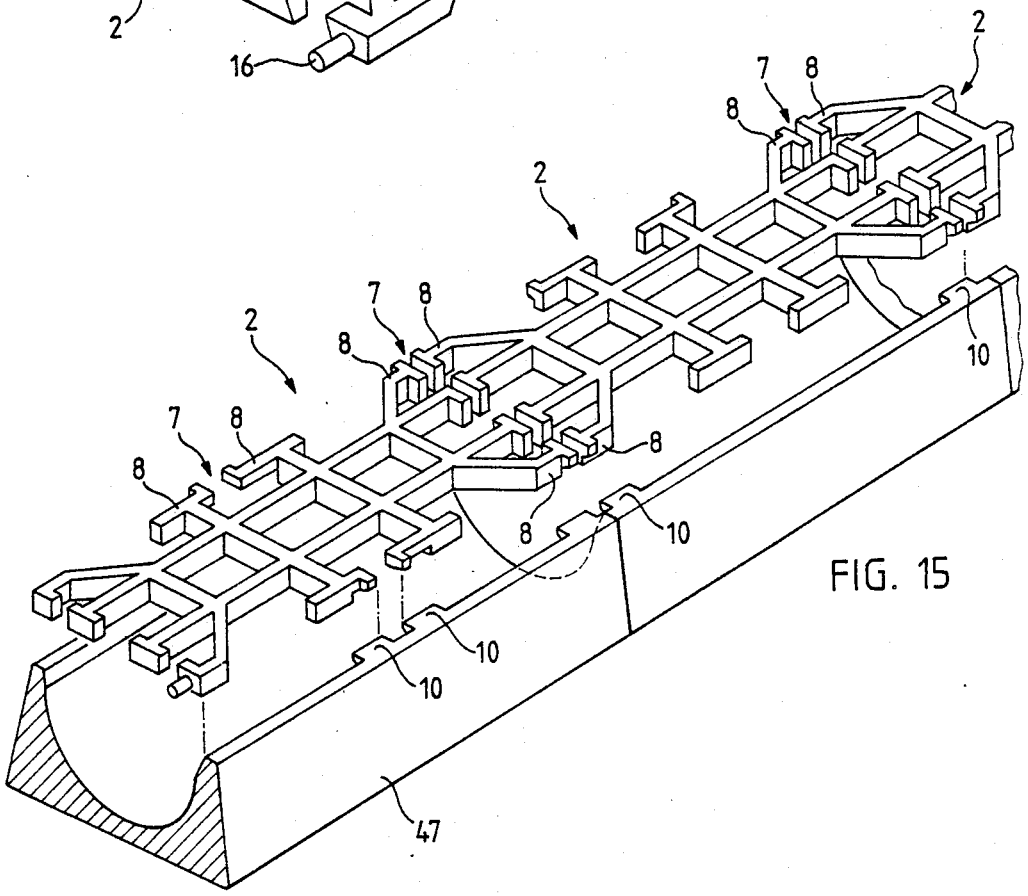

FIG. 15 A diagrammatically represented view of a water drain, whose grating is constructed in multipart manner, the grating parts, similar to the grating of FIGS. 10 and 14, being provided with locking devices.

Figure 16:
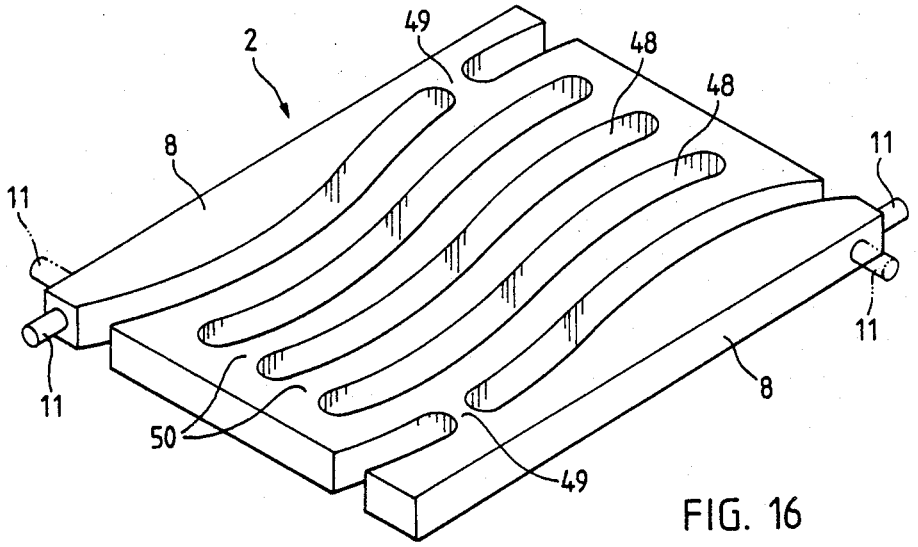

FIG. 16 A diagrammatically represented view of a grating with marginal closing members.

The covering shown in FIG. 1 has a frame 1, in which is inserted a grating. The latter comprises crossing rods 3, 4 and is arranged in such a way that at the ends of the rods, in each case free end portions 5, 6 project over the last rod. Grating 2 is supported with its end portions 5, 6 on an inner support flange 9 of frame 1.

In each case one locking device is arranged in the two corners of the covering according to FIG. 1. The locking device 7 comprises a closing member 8 and a retaining member 10, cf. FIG. 2, in which the closing member 8 is constructed as a specially shaped end portion, which is arranged at the same point as end portion 5. Closing member 8 differs from end portion 5 in that it has a reduced wall thickness and a smaller overall height, cf. FIG. 2. The overall height of the closing member 8 decreases towards its free end and ends in a closing finger 11, which projects into a groove 12 in frame 1. Groove 12 is additionally covered by a lip 13, which forms part of the border of frame 1. Lip 13 only extends into the vicinity of closing finger 11.

It is necessary for the positive securing of the grating 2 in frame 1 for the closing member 8 to be pivoted elastically sidewards, so that it can engage in groove 12. An elastic deformation of closing member 8 is required for removing the grating 2 until the closing finger 11 is located outside grooves 12 and lip 13. The bending position is indicated in broken line form in FIGS. 1 and 2.

In the case of the grating inserted in the frame 1 in FIG. 3, the locking device 7 has a similar construction to that of FIG. 1. The closing member 8 is constructed as an elastically deformable arm, which is constructed with a band joint 15, which can e.g. be a band element of the type known in connection with plastics. In this case the closing member 8 need not be given a special shape and instead only requires at the free end the closing finger 11, which is inserted in the groove 12 in frame 1. If frame 1 has an adequate wall thickness, there is no need to shape a lip and instead the groove 12 is led upwards at its end at a point where the closing member 8 must be bent towards it.

In the same way it is possible to provide locking devices 7 in each corner of frame 1. However, it is possible to provide two opposite end portions 5 with a pin 16, cf. FIGS. 10 and 14, which is insertable into a slot 38 or 43 of frame 1, cf. FIGS. 12 and 13, as a bearing support for pin 16. If the locking members 8 of the two locking devices 7 arranged on opposite sides are engaged, it is no longer possible to remove pin 16 from a slot 38 or 43.

FIG. 4 diagrammatically shows a grating 2, whose rods 3, 4 are arranged in a random manner. It is important that the frame 2 has no free end portions and that instead rods 3 are bounded by marginal rods 18. To enable the insertion of locking device 7, at the corners of grating 2 the marginal rods 18 are shortened, so that a free end portion 5 is formed, which can be constructed as a closing member 8. Closing member 8 forms the extension of a rod 3, on which short end portions 6 project, with which the grating 2 is supported on the frame support flange, cf. also FIG. 1.

FIG. 5 shows a frame, on which elastically bendable closing members 8 are arranged parallel to one frame side and the roots 19 thereof are located on opposite frame sides, cf. also FIG. 6.

FIG. 6 shows that a projecting retaining finger 20 is located at the free end of closing member 8 and forms an undercut 21 for a finger provided on a not shown grating. For inserting a grating in frame 1 according to FIG. 6, the two closing members 8 must be elastically laterally deformed. When the grating or cover is inserted, the two closing members can spring back into their normal position, in which they positively secure the frame. For the easy manufacture of the frame 1, its corners, where the free end of closing member 8 ends, can be subdivided into two parts and then assembled.

The described locking devices 7 all have a similar construction and comprise an elastic, flexible closing member 8 and a dimensionally stable retaining member 10. The elastically flexible closing member 8 can either be placed in the cover or grating 2, cf. FIGS. 1 to 4, or in frame 1, cf. FIG. 6. In the latter case, the dimensionally stable retaining member is a closing finger arranged on the grating or cover. The locking devices 7 described in FIGS. 7 to 15 also function in this way, the variants particularly relating to constructional modifications.

FIG. 7 diagrammatically shows a covering with a grating 2, the latter having transverse rods 24 and longitudinal rods 25, the latter forming projections 26 on the ends. By means of projections 26, grating 2 is mounted on the support flange 14 of frame 1.

Dimensionally stable retaining members 10 are fixed in support flange 14 of frame 1 between projections 26, cf. also FIG. 8. The retaining members 10 have a concave, oppositely directed surface portion 28, under which is provided an offset 29, in which each case engages one closing member 8. As can be gathered from FIG. 7, the closing member 8 is a bent arm, whose foot part 30 is supported on rods 24, 25. To the foot part 30 is connected a leg 31, whose free end engages in offset 29 in the normal position and a convex portion 28 of the retaining member 10 is provided for this purpose. The grating 2 can be pressed down with a certain force, so that the two legs 31 are deformed in such a way that they slide over the convex portion 28 and subsequently engage in offset 29.

For the removal of grating 2, it is necessary to press back the two legs 31, which is possible with the aid of the fork-like tool 33 shown in FIG. 9. For this purpose the two arms 34 of tool 33 form a slot 36 and have oppositely directed facets 35, so that the end of slot 36 is large enough for the arms 34 to be placed over the two legs 31, so that the legs are elastically bent against one another and consequently grating 2 can be raised.

In the same way, on the opposite, not shown side of grating 2, the corresponding closing members 8 can be deformed by tool 33 and consequently the grating 2 can be raised from frame 1 on this side. For the positive securing of grating 2, it is necessary to have four locking devices 7, whereof in each case two are homologously arranged.

Grating 2 comprising longitudinal rods 25 and transverse rods 24 shown in FIG. 10 has a locking device 7 similar to that of FIG. 7. As with all the other gratings, the transverse rods 24 and longitudinal rods 25 are dimensionally stable and only the closing members 8 are elastically deformable. In FIG. 10 these closing members are sloping rods arranged on the corners of a longitudinal and a transverse rod and which cooperate with a closing member 10, cf. FIG. 11, of the not shown frame 1. In this case it is necessary to spread apart the closing members 8, so that they can engage below the projection 37 of retaining member 10. On the side opposite to the locking device 7 pins 16 are arranged on the faces of grating 2 and are guided in grooves 38 in the frame 1, cf. FIG. 12. Thus, grating 2 can initially be inserted in grooves 38 and then, accompanied by the deformation of the closing members 8, can be engaged in the retaining members 9 on frame 1, so that the grating 2 is positively secured in frame 1. The mounting of pins 16 can also be performed according to FIG. 13 and for this purpose it is possible to provide in frame 1 a portion 42 with a greater wall thickness, in which is formed a slot, which also serves as a mounting support for pins 16 on the faces of grating 2.

The grating according to FIG. 14 is constructed in a similar manner to that of FIG. 10, but the closing members 8 are constructed as rods 45 running parallel to the longitudinal rods 24. The rods 45 are arranged on a dimensionally stable end portion 5 and project with a lug 46 into the projection 37 of retaining member 10. For the engagement of rods 45, they must be deformed elastically inwards, so that they can be pushed over the projection 37. The concave shape of projection 37 offers the possibility of detaching the grating 2 with a certain force from retaining member 10. Thus, it is a positive connection, which can be released on exceeding a certain force.

FIG. 15 shows the use of the gratings according to FIGS. 10 and 14 as a series grating used for covering a discharge channel or gutter 47. In this case, several locking devices 7 are provided, which comprise individual or pairwise arranged, elastically deformable closing members 8, which are constructed in a similar manner to the locking devices of FIGS. 10 and 14. The corresponding retaining members 10 are provided on the edge of gutter 47.

FIG. 16 shows another grating 2, which has juxtaposed, curved slots 48. Two facing grating borders are constructed as a closing member 8, which is connected by means of a flexible web 49 to the remainder of grating 2. This remaining part of the grating forms a dimensionally stable part, because the rods 50 between slots 48 are interconnected at both ends. At the ends of closing members 8 are provided closing fingers 11, which can engage in the retaining member of the not shown frame. As can be gathered from FIG. 16, closing fingers 11 can also be arranged displaced by 180° at the end of closing members 8, as shown in broken line form in FIG. 16.

An elastically deformable material is to be used for the retaining members 8 of locking devices 7. As the covers and gratings 2 are usually made in one piece, it is suitable to use for this purpose e.g. ductile cast iron in the form of nodular graphite or Meehanite cast iron. However, an optionally reinforced plastic can also be used.

In place of the gratings 2 shown in FIGS. 1, 3, 4, 7, 10, 14, 15 and 16, it is also possible to use covers and then corresponding recesses must be provided for the locking devices 7.

I claim:

1. A cover assembly for closing an opening, comprising a dimensionally stable and rigid frame; a substantially rigid covering mounted in said frame in a non-prestressed position; and locking means arranged on said frame and said covering for detachably-securing said covering to said frame, said locking means including two rod-like elastically deformable closing members and two rigid retaining members, said closing members each including an elastically deformable web having a closing finger, each retaining member being provided with a groove engaging said finger for a positive securing of said covering to said frame; said two elastically deformable closing members being provided on a border of said covering and said two retaining members being provided on said frame, wherein said locking means is located on one side of the covering, whilst a pivot mounting is provided on the opposite side of the covering, the pivot mounting comprising in each case a pivot pin fixed to a respective face of the covering and in each case a bearing groove provided in the frame.

2. A cover assembly for closing an opening, comprising a dimensionally stable and rigid frame; a substantially rigid covering mounted in said frame in a non-prestressed position; and locking means arranged on said frame and said covering for detachably-securing said covering to said frame, said locking means including at least one rod-like elastically deformable closing member provided on one of said frame and said covering and at least one rigid retaining member provided on another of said frame and said covering, said closing member including an elastically deformable web having a closing finger, said retaining member being provided with a groove engaging said finger for a positive securing of said covering to said frame, wherein the closing member is fixed to said frame and has a free end provided with a retaining finger, forming an undercut for receiving a finger fixed to said covering.

3. A cover assembly for closing an opening, comprising a dimensionally stable and rigid frame; a substantially rigid covering mounted in said frame in a non-prestressed position; and locking means arranged on said frame and said covering for detachably-securing said covering to said frame, said locking means including two elastically deformable closing members arranged in a homologous manner on a border of the covering and two lug-like retaining members fixed on said frame, said closing members being enageable with said retaining members for a positive securing of said covering to said frame, said two closing members being positioned in one of a marginal recess of said covering and a corner of a crossing of two rods of said covering and extending against said frame.

* * * * *